United States Patent [19]

Schmidt et al.

[11] Patent Number: 4,696,145

[45] **Date of Patent: * Sep. 29, 1987**

[54] AUTOMATIC CONTAINER STUFFING APPARATUS AND METHOD

[75] Inventors: Richard Schmidt, Ambler, Pa.; Joseph A. Pizzo, Cherry Hill, N.J.

[73] Assignee: Enviro-Spray Systems Incorporated, Hoboken, N.J.

[ * ] Notice: The portion of the term of this patent subsequent to Jun. 17, 2003 has been disclaimed.

[21] Appl. No.: 570,376

[22] Filed: Jan. 13, 1984

[51] Int. Cl.[4] ..... B65B 1/24

[52] U.S. Cl. ..... 53/436; 53/282; 53/449; 53/470; 53/474; 53/529

[58] Field of Search ..... 53/117, 115, 121, 251, 53/429, 435, 436, 438, 529, 513, 449, 470, 474, 282; 493/407

[56] References Cited

U.S. PATENT DOCUMENTS

| | | | |
|---|---|---|---|
| 1,713,068 | 5/1929 | Bach . | |
| 1,910,327 | 5/1933 | Gaynor | 53/368 X |
| 2,036,796 | 4/1936 | De Markus et al. | 53/368 X |
| 2,420,983 | 5/1947 | Salfisberg | 53/436 |
| 2,718,345 | 9/1955 | Howard | 226/69 |
| 2,789,586 | 4/1957 | McBean | 141/20 |
| 3,078,630 | 2/1963 | Mayer et al. . | |
| 3,123,104 | 3/1964 | Weston . | |
| 3,179,041 | 4/1965 | Luthi et al. | 53/529 X |
| 3,186,140 | 6/1965 | Bogdanovich | 53/529 |
| 3,206,910 | 9/1965 | Lidstrom | 53/122 |
| 3,273,300 | 9/1966 | Watrous et al. | 53/435 |
| 3,477,562 | 11/1969 | Allen et al. | 53/436 X |
| 3,580,166 | 5/1971 | Longo | 100/49 |
| 3,722,403 | 3/1973 | Longo | 100/49 |
| 3,729,892 | 5/1973 | Aslund et al. | 53/429 X |
| 3,906,701 | 9/1975 | McIntyre | 53/429 X |
| 4,376,500 | 3/1983 | Banks et al. | 222/386.5 |
| 4,388,795 | 6/1983 | Stohlquist | 53/435 |
| 4,510,734 | 4/1985 | Banks et al. . | |
| 4,531,341 | 7/1985 | Bittner . | |

FOREIGN PATENT DOCUMENTS

| | | | |
|---|---|---|---|
| 749235 | 5/1956 | United Kingdom . | |
| 2084954 | 3/1982 | United Kingdom | 53/121 |

OTHER PUBLICATIONS

U.S. Patent Appln. Ser. No. 398,887 for Can Stuffer and Method, filed Jul. 16, 1982.

*Primary Examiner*—Robert L. Spruill
*Assistant Examiner*—Steven P. Weihrouch
*Attorney, Agent, or Firm*—Kenyon & Kenyon

[57] ABSTRACT

An automatic container stuffing apparatus and method is disclosed. The apparatus is especially useful for the insertion of two component gas generating pouches into pressurized containers of the type wherein the pressurizing gas does not come into contact with the contents of the container. The apparatus receives the pouches, performs necessary bursting operations to initiate gas pressurization, compresses the pouch into an elongate shape and inserts the pouch into a container. Two embodiments are disclosed. One embodiment receives pouches in a continuous sheet and separates the pouches from the continuous sheet prior to insertion into a container. Another embodiment receives individual separate pouches arranged in a stack extending in the longitudinal direction of a transport conveyor, thus eliminating the need to separate the pouches from a continuous sheet. Two embodiments of conveyor arrangements for moving containers into position to have pouches inserted therein and for moving the containers away are also disclosed.

71 Claims, 19 Drawing Figures

66
60
42
47
62
64
12
72
62
46
52
50
54
48

210
254
256
80
80
171
173
226
221
214
220
218
222
230
234
224
220
216
222
200
252
250

66
60
12
42
41
47
44
72
62
64
62
46
52
48
50
54

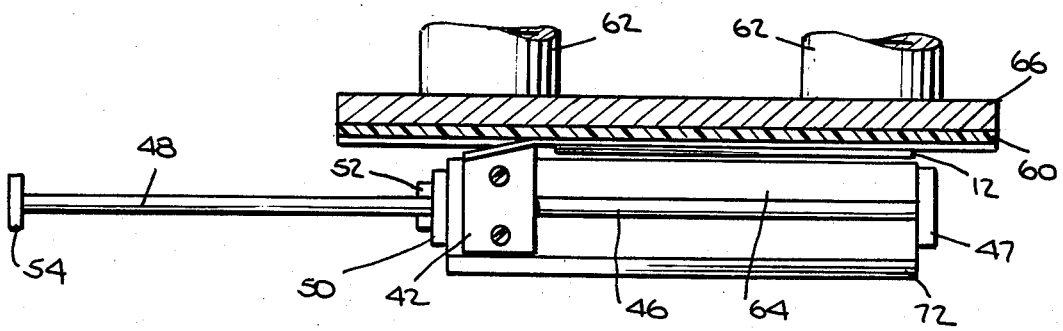
Fig. 7.
Fig. 8.
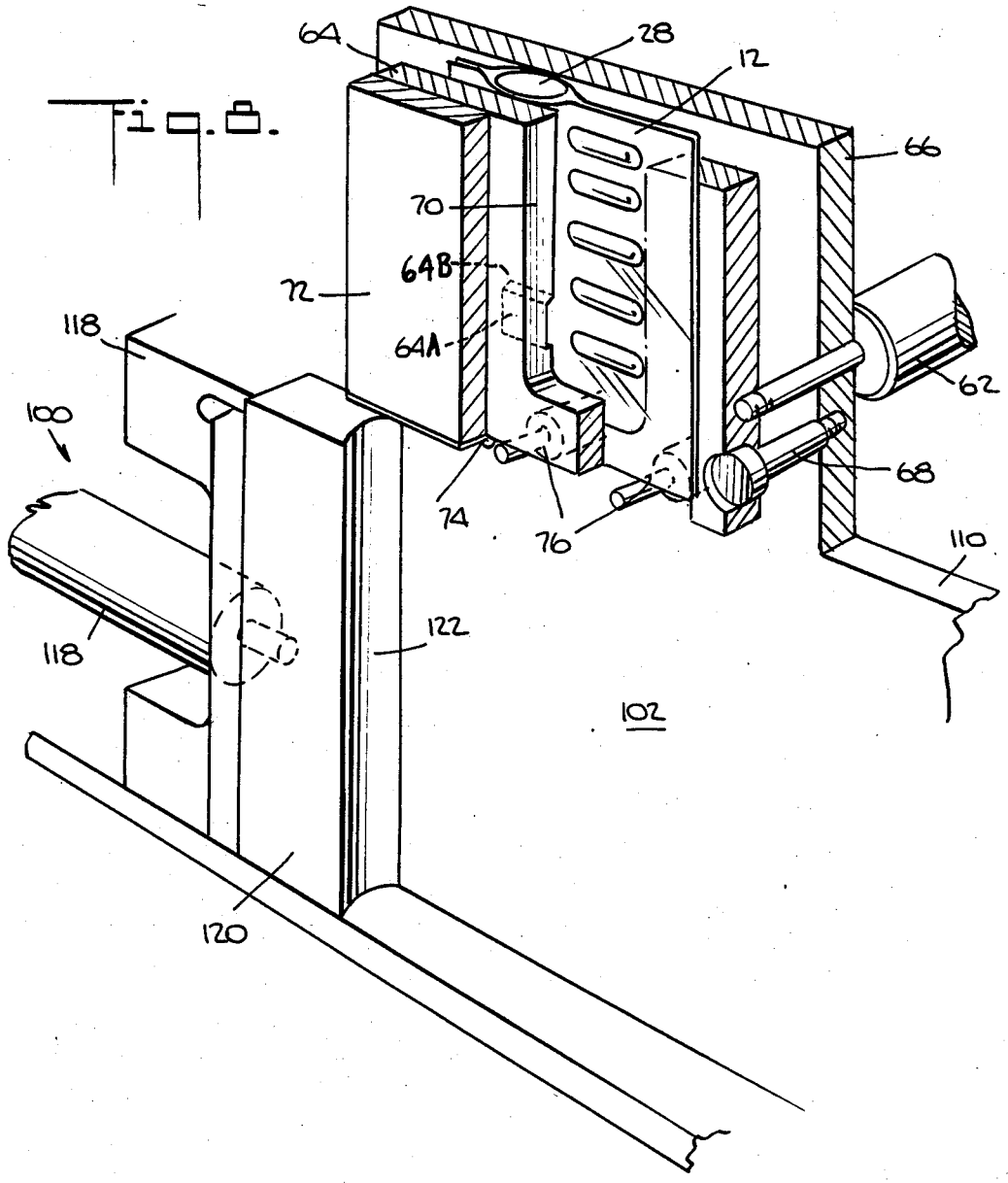

132
100

80
370
404
370
406
356
354
350
374
374
412
410
352
376
390
232
378
394
380
358
398
396
402
400
362
360
382

AUTOMATIC CONTAINER STUFFING APPARATUS AND METHOD

BACKGROUND OF THE INVENTION

The present invention relates to automatic container-stuffing apparatus and methods and more particularly to automatic apparatus and methods for inserting expandable pouches into pressurized containers of the type wherein the propellant is created by chemical reaction within the pouch after the pouch is inserted into the container, all without the propellant gas contacting the product or leaving the container. Expandable pouches of this type are described in U.S. Pat. No. 4,376,500 to Banks and Magid, owned by the assignee of the present application. A container stuffing device for expandable pouches of this type is described in application Ser. No. 398,887, filed July 16, 1982, also owned by the assignee of the present application. The device described in said application, however, is not capable of automatically and systematically inserting expandable pouches into containers on a large scale and on a continuous basis.

SUMMARY OF THE INVENTION

It is an object of the present invention to provide a fully automatic apparatus and method for stuffing or inserting a flexible sheet product, such as a generally flat expandable pouch of the type described, prior to expansion, into a can or container.

It is a further object to provide an automatic apparatus which feeds pouches of the type described to a pouch deformation and insertion station where the pouches are deformed into an elongate shape and then inserted into the container.

It is yet a further object to provide an automatic apparatus which provides means for activating the generation of pressurizing gas within the expandable pouches just prior to the time that they are inserted into the containers.

It is still a further object to provide an apparatus which allows pouches of the type described to be shipped to a location where the apparatus is located and then inserted into a container automatically, the apparatus insuring that pressurization of the container occurs after insertion.

It is yet still a futher object of the invention to provide automatic container stuffing apparatus wherein the containers are stuffed with expandable pouches which are packaged in a continuous sheet of individual successively attached pouches and which automatically separates successive pouches prior to insertion into the container.

It is still another object to provide an apparatus which receives separate stacked pouches from a conveyor and which then activates the pressurizing gas with the pouches and inserts the pouches into the containers.

It is yet another object of the invention to provide means for conveying containers which are to have pouches inserted therein to a pouch deformation and insertion station and to convey the containers away from the station after they have been stuffed with the expandable pouches.

These and other objects are achieved in one embodiment of the present invention by an apparatus for inserting flexible sheet products into containers, each of the products comprising an expandable pouch for pressurizing a container, the pouch including burstable means for generating pressurizing gas within the pouch, the apparatus comprising means for compressing the sheet products so as to rupture the burstable means, means for deforming the sheet products into an elongate shape and means for successively inserting the elongate sheet products into the containers. In a preferred embodiment, the apparatus also includes conveyor means for conveying the containers for receiving the separated sheet products to a position below the inserting means.

The means for deforming preferably comprises means having a generally flat internal chamber for receiving the flexible sheet product and pusher means mounted in the chamber extending along one edge thereof and movable laterally toward and away from the opposite chamber edge, for deforming the flexible sheet product in the chamber into an elongate folded sheet product extending along the opposite chamber edge. The means for inserting preferably comprises ejector means movable in the chamber along the opposite edge for endwise ejection of the folded sheet product into a container having an open top positioned below the ejector means.

The burstable means contained in the expandable pouch may comprise, for example, a bag or recess within the pouch containing one component of a two component gas generating system or a solvent, which when burst, reacts with the other component present in the pouch to initiate the generation of pressurizing gas. A time delay means may be built into the pouches so that gas generation does not occur instantly. This allows time for later manufacturing steps, such as the provision of a valve mechanism on top of the container.

The compressing or bursting means preferably comprises first plate means, second plate means extending parallel to and adjacent the first plate means and spaced apart therefrom, the sheet products being received between the first and second plate means and actuating means for relatively moving the first and second plate means toward each other so as to successively compress the flexible sheet products, thereby bursting the burstable means. If the pouch includes an area which is not to be compressed, such as a timed recess containing one component of the gas generating system, one of the first and second plate means preferably includes an aperture disposed so that when the pouch is received between the first and second plate means, the area which is not to be compressed is located in alignment with the aperture, thereby preventing compression of the area when the first and second plate means relatively move toward each other.

Preferably, the apparatus also includes means for directing fluid contained within the burstable means in a predetermined direction in the pouch. In one embodiment, one of the plate means includes a recess disposed on an inner surface so that fluid within the burstable means is forced into the recess when the plate means compress the sheet product. By proper location and structure of the recess, the fluid within the burstable means may be directed in a predetermined direction within the pouch, thus maximizing gas generation.

Since the burstable means of the flexible sheet product is ruptured by the apparatus of the present invention on location just prior to insertion into a container, problems encountered in transporting and storing two component gas generating pouches are entirely eliminated, since gas generation only occurs after the burstable means is mechanically ruptured. This prevents premature gas generation prior to the time the pouch is inserted into the container.

In one embodiment, the apparatus receives separate sheet products arranged in a stack of the sheet products on a transporting means, the sheet products being individually received and inserted into the space between the first and second plate means.

The transporting means may comprise first conveyor means for conveying the flexible sheet products to a first position, means for engaging the sheet products at the first position, and second conveyor means for conveying the sheet products from the first position to a second position between the first and second plate means. Preferably the engaging means comprises suction means and the second conveyor means comprises endless belt means. Means for directing a blast of air against the endless belt means preferably is provided to keep the sheet product in contact with the endless belt means.

In another embodiment, the sheet products are packaged in a continuous sheet of the sheet products and cutting means are provided for separating the sheet products from the continuous sheet. In this embodiment, the cutting means is preferably coupled to the compressing means and separation is performed subsequent to rupture of the burstable means.

Furthermore, in the embodiment including the separating means, the separating means comprises horizontally extending guide means disposed on one of the first and second plate means, a cutting knife slidably disposed on the guide means, the actuating means of the bursting means moving the cutting knife into engagement with the flexible sheet product, and means for moving the cutting knife from a first position to a second position along the guide means so as to separate the sheet product from the continuous sheet.

The invention also includes various embodiments of the conveyor means for conveying the containers for receiving the flexible sheet products to and from the inserting means. In one such embodiment, the conveyor means includes first means for moving a plurality of containers successively to a position adjacent the inserting means, second means for successively pushing each container away from the first means and to a position below the inserting means and for pushing each container once a flexible sheet product has been inserted therein away from the inserting means, and third means for successively receiving each container from the second means once a flexible sheet product has been inserted therein.

An alternative embodiment of the conveyor means comprises first means for moving a plurality of containers successively to a position adjacent the inserting means, turntable means disposed below the inserting means, means for directing each of the containers from the first means onto the turntable means, means for guiding each of the containers on the turntable means to a position below the inserting means and subsequently away from the inserting means and second means for moving each of the containers away from the turntable means, the turntable means receiving each of the containers and moving each of the containers successively to a position below the inserting means so that the flexible sheet products may be inserted into the containers.

In a preferred embodiment of the conveyor means employing the turntable means, the guiding means comprises plate means disposed above the turntable means, the plate means having a channel separating the plate means into two sections, the channel having an entrance area for receiving each of the containers and an exit area for forcing each of the containers onto the second means.

In both embodiments of the conveyor means, lifting table means may be utilized to raise the containers into a position immediately below a cylindrical aperture in the inserting means so that the containers can receive the flexible sheet product.

Furthermore, the directing means preferably comprises lever means pivotably mounted adjacent the first means and extending across the first means, spring means biasing the lever means against stop means, whereby the containers on the first means are guided onto the turntable means by the lever means, the lever means being forced away from the first means when the turntable means cannot accept a container so that a container not accepted by the turntable means continues past the lever means on the first means.

The invention also includes a method for receiving individual sheet products and for inserting the sheet products into containers. Additionally, the invention includes a method for separating flexible sheet products from a continuous sheet of said products and for inserting the separated products into containers. The methods are more clearly described in the detailed description which follows.

Other objects, features and advantages of the invention will be apparent from a reading of the detailed description which appears below.

BRIEF DESCRIPTION OF THE DRAWINGS

These and other objects of the present invention will be described in greater detail in the following detailed description with reference to the drawings in which:

FIG. 7 shows the cutting means at the end of the cutting operation;

FIG. 8 is a sectional view of a portion of the apparatus showing features of the bursting and pouch deformation and insertion stations of the apparatus just prior to bursting of an individual expandable pouch;

DETAILED DESCRIPTION

Figure 1:
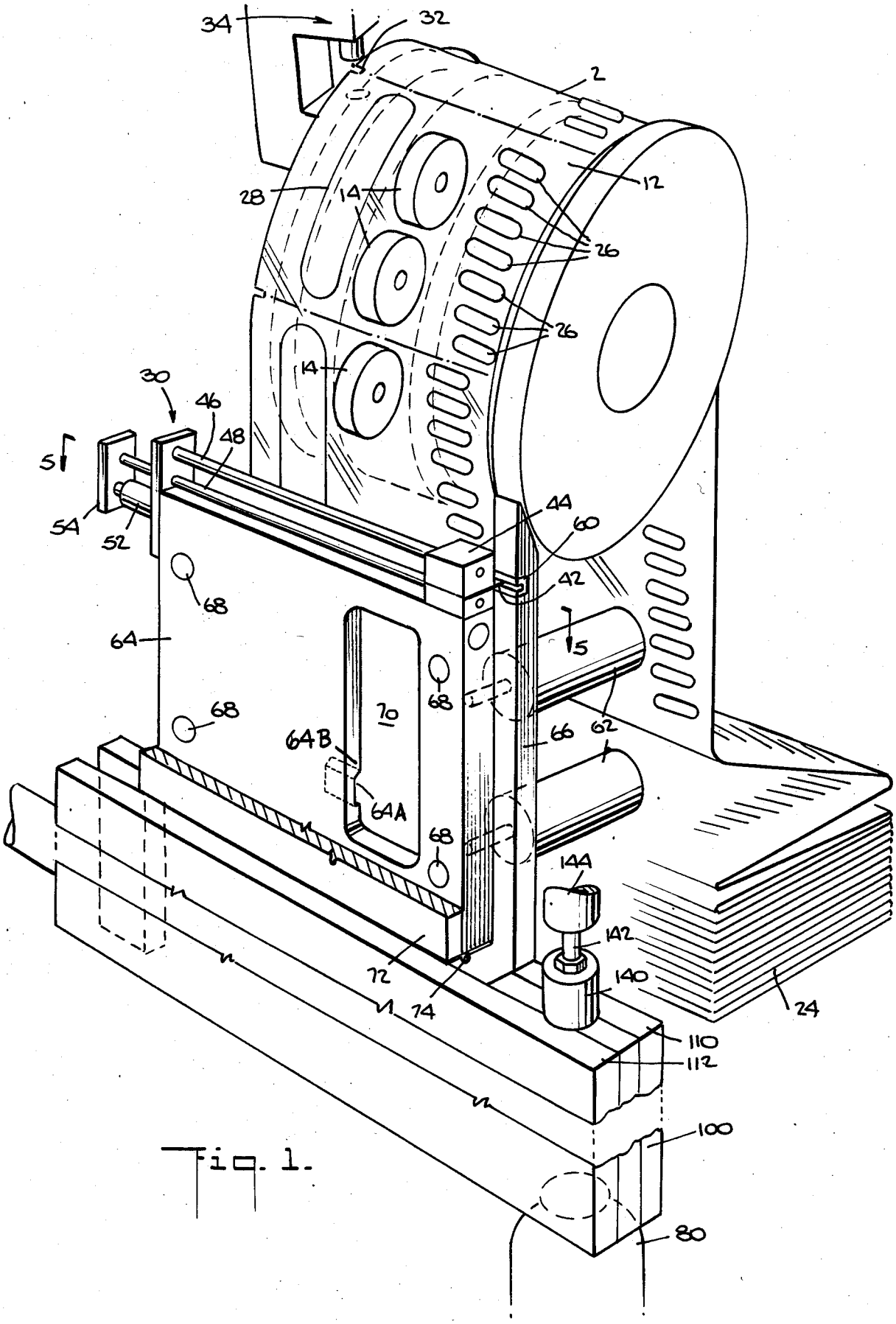
FIG. 1 is a perspective view of one embodiment of part of the automatic container stuffing apparatus showing the main drive pulleys, pouch separating and bursting stations and parts of the pouch deformation and insertion station.
Figure 2:
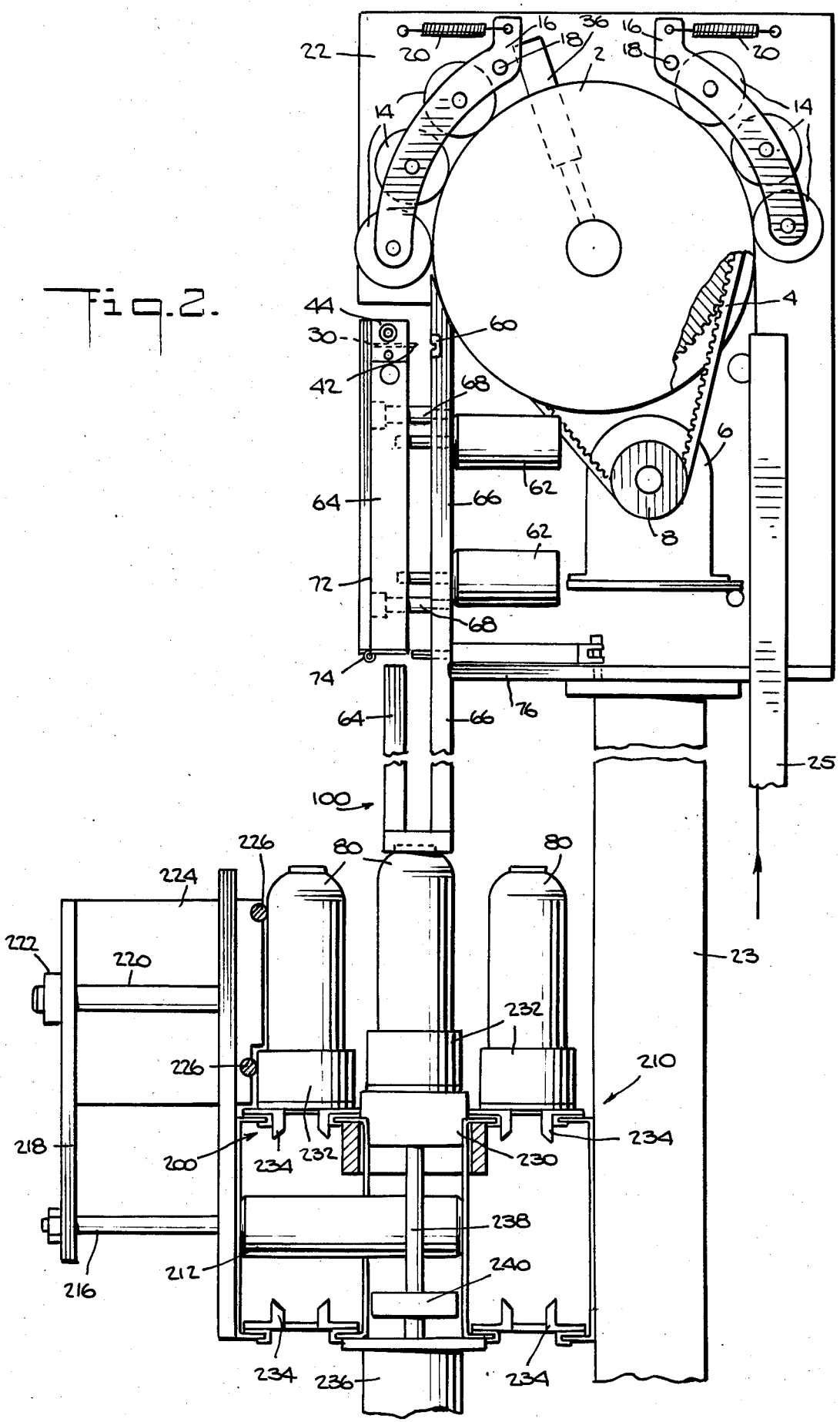
FIG. 2 is a side view of the apparatus shown in FIG. 1 showing the pouch deformation and insertion station and the conveyor system in more detail.
Figure 3:
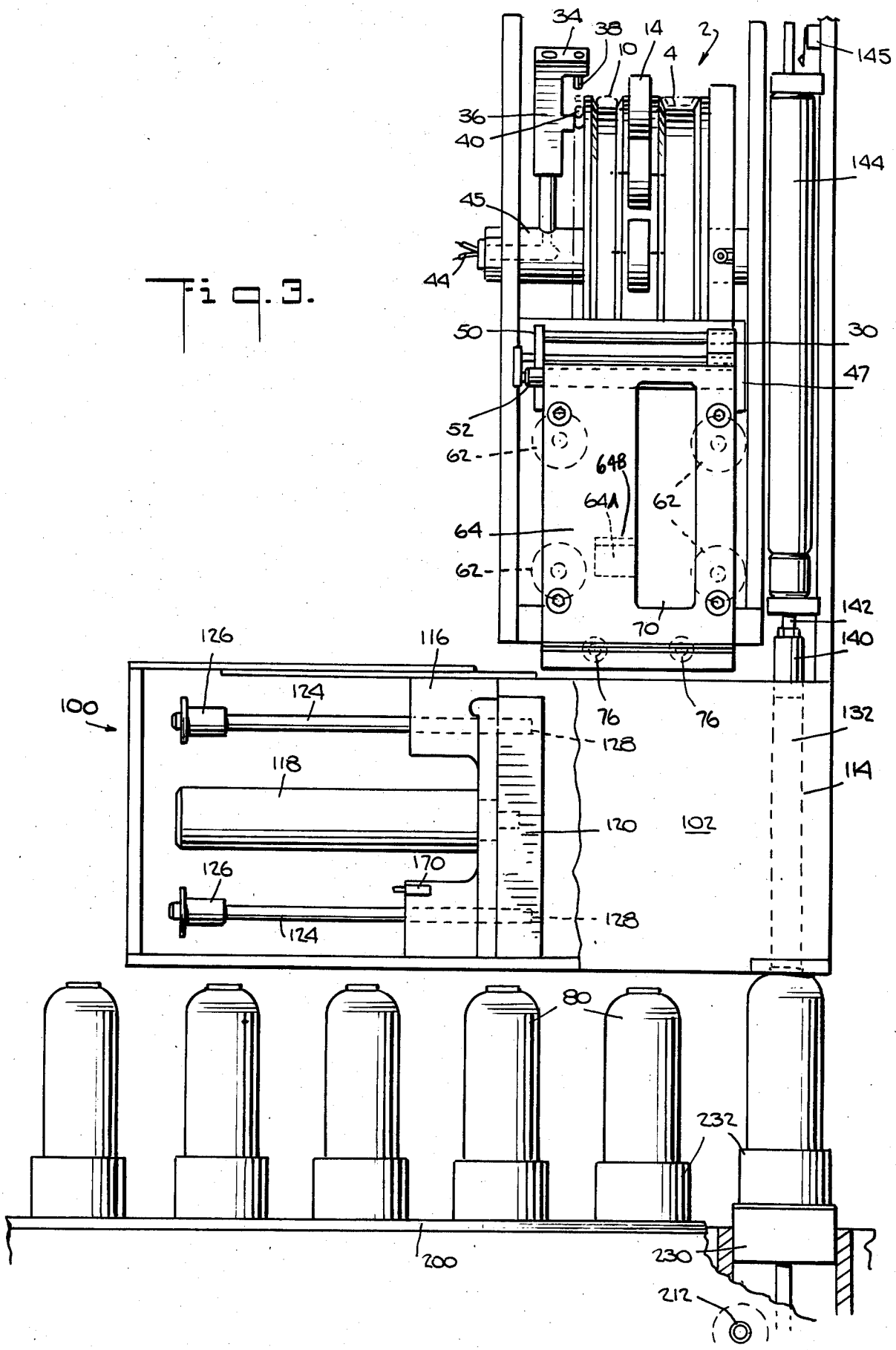
FIG. 3 is a front view of the apparatus shown in FIGS. 1 and 2 showing the pouch deformation and insertion station in yet more detail.

With reference now to the drawings and especially FIGS. 1 to 3, one embodiment of the automatic container stuffing apparatus having a main drive pulley or roller indicated generally by reference numberal 2 is shown. The pulley 2 is driven by a timing belt or chain 4 by a servo motor 6 via a second pulley 8. The timing belt may be of the cogged type as shown or of some other suitable construction. Motor 6 may be an electric or hydraulic servo motor or may be of some other known construction. An additional drive belt 10 may be provided as more clearly shown in FIG. 3. The exterior surfaces of the belts 4 and 10 preferably are provided with a friction surface so as to properly guide the continuous sheet of pouches 12 around the drive pulley. A plurality of rollers 14 are mounted to supports 16 for rotation against drive pulley 2, the supports being pivotally mounted at pivots 18 and biased against drive pulley 2 by springs 20 coupled to main supporting member 22, which in turn is supported by a pedestal 23.

In the embodiment shown in FIG. 1-3, pouches 12 may be packaged in a continuous circular roll or in a continuous stacked arrangement as shown at 24. The continuous sheet of pouches is directed toward main pulley 2 by a supporting guide, which may be a trough-shaped channel 25. Each individual pouch 12 may include a plurality of recesses 26 arranged in staggered fashion, each of which contain one component of a two component gas generating system, as described, for example, in U.S. Pat. No. 4,376,500 to Banks et al, assigned to the assignee of the present application. The staggered arrangement of recesses 26 enables time dependent generation of propellant gas once the pouch is inserted into a container. The second component of the gas generating system may generally be provided in the bottom region of the pouch 12. A separate, independent bag 28 is also contained within the pouch 12 and may contain the first component of the gas generating system or a solvent, such as water, which, when burst within the pouch 12, provides means for initiating the generation of gas within the pouch, and thus inflation of the pouch. The staggered arrangement of recesses 26 allows the first component to come into contact with the second component in a time dependent fashion, as more fully explained in the patent referred to above. The apparatus according to the present invention provides means for automatically bursting the bag 28 within the pouch 12 just prior to insertion into a container to initiate activation of the gas generating compounds.

Figures 4, 5, 6:
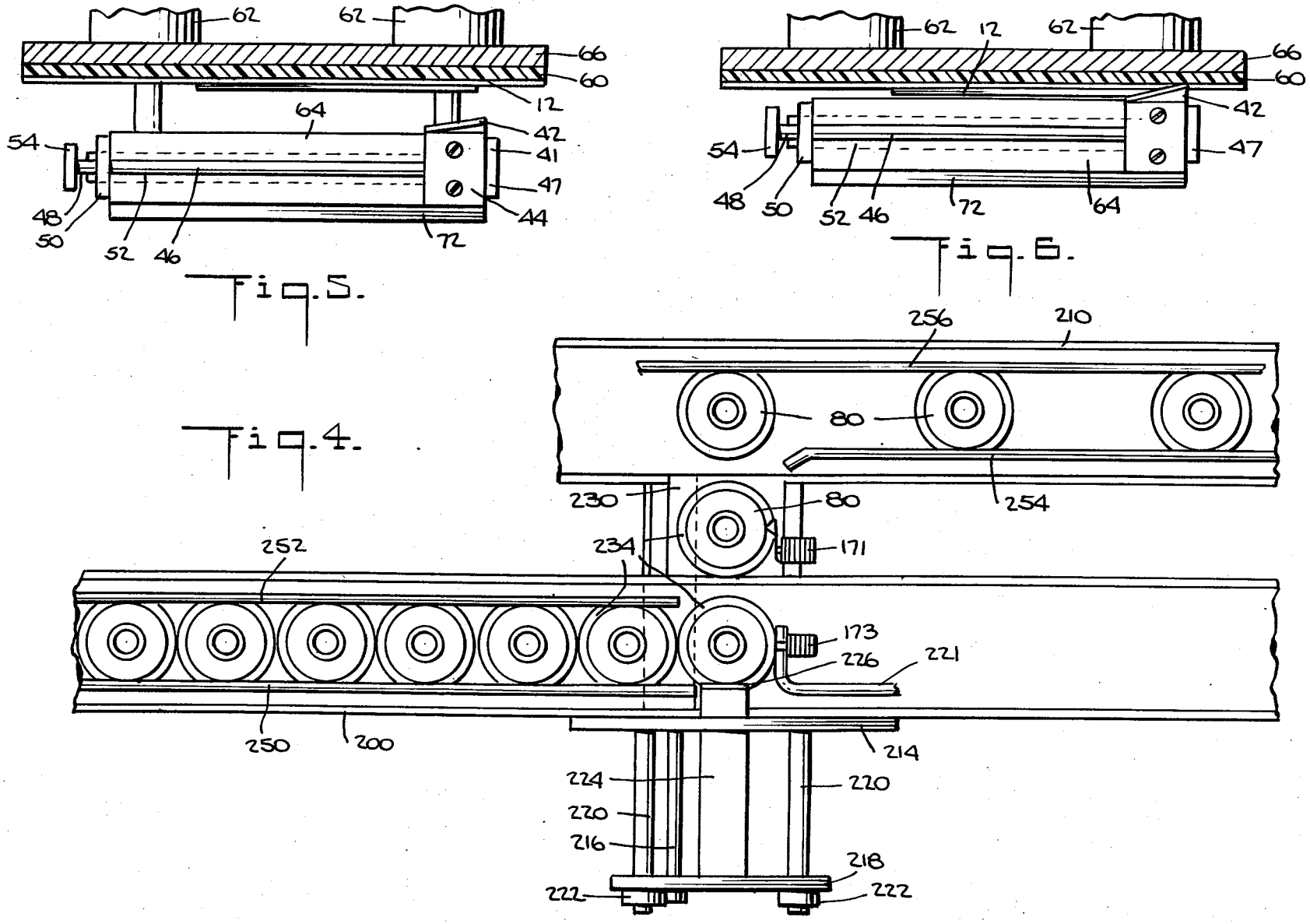
FIG. 4 is a top view of a portion of the apparatus showing the container conveyor system in more detail.
FIG. 5 is a top view of one of the components of the apparatus showing the details of construction of the cutting means for separating successive expandable pouches from one another employed in one embodiment of the present invention taken along lines 5—5 of FIG. 1 and showing the cutting means prior to the cutting operation.
FIG. 6 shows the cutting means at the start of the cutting operation.
Figure 9:
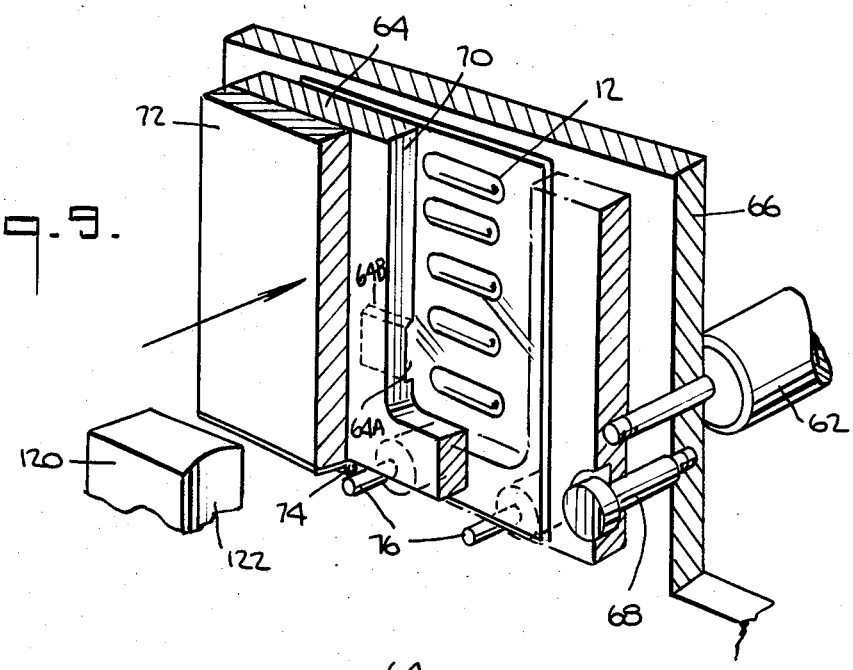
FIG. 9 is a sectional view illustrating the bursting station during the bursting operation.

In the embodiment shown in FIGS. 1-3, successive pouches 12 are physically connected to one another and must be separated by a cutting means, generally indicated at 30 and shown in more detail in FIGS. 5, 6 and 7. In order to synchronize the cutting operation with the passage of the pouches over the drive pulley 2, small apertures 32 are disposed at equally spaced intervals along an edge of the interconnected series of pouches 12, preferably approximately at the line separating one pouch from the next. A sensing means, indicated generally at 34, is used to generate a signal to stop drive pulley 2 and to activate cutting means 30 to separate one pouch 12 from the following pouch. In a preferred embodiment, a generally F-shaped support 36 contains a photocell 38 and lamp 40. F-shaped support 36 is mounted to stationary axle 45 on which pulley 2 is rotatably mouned. F-shaped support 36 is made hollow so that wires 44 for the lamp and photocell may be connected to control circuitry for controlling operation of the apparatus. When an aperture 32 is sensed, a signal is generated by photocell 38 to the control circuitry to stop servo motor 6 and initiate the cutting operation by cutting means 30, to be described in more detail below.

Cutting means 30, shown in more detail in FIGS. 5, 6 and 7, includes a cutting blade 42 mounted to blade support 44. Blade support 44 is slidably disposed on a first guide rail 46 and securely attached to second rail 48. Stops 47 and 50 are provided for limiting the travel of the cutting blade 42 and block 44. An activating means, such as a pneumatic or hydraulic cylinder and piston arrangement 52 is coupled to rail 48 via a connecting bracket 54. When activated, cylinder 52 drives connecting bracket 54 to the left as more clearly shown in FIGS. 5, 6 and 7, thus driving cutting blade 42 across the surface of the sheet of pouches and separating a pouch 12 from the following one. Prior to activating cylinder 52, the cutting blade 42 must be moved into contact with the continuous sheet. A resiliant grooved backing material 60 serves as the platen for blade 42. In order to accomplish this movement, cylinders 62, attached to bursting plate 64, are employed. When cylinders 62 retract, bursting plate 64, which will be described below with respect to the bursting operation, moves toward plate 66, thereby moving the cutting blade 42 into contact with the continuous sheet and at the same time, rupturing the burstable bag 28. In place of pneumatic or hydraulic cylinders 52 and 62, other activating means could be used, such as a screw device or electrical solenoid, for example.

As indicated, simultaneously with the movement of the cutting blade toward the continuous sheet, bag 28 contained within the pouch 12 is burst by the operation of cylinders 62 pulling bursting plate 64 into plate 66 when a pouch is present between the plates 64 and 66. Guides 68 are provided to insure even movement of plate 64. An aperture 70 is located in plate 64 to prevent damage to the timed release recesses 26 in the pouch being compressed by the operation of bursting plate 64. This ensures that only bag 28 is burst, thus initiating the generation of propellant gas in the pouch 12 by the water or other solvent contained in the burst bag 28.

Figure 9A:
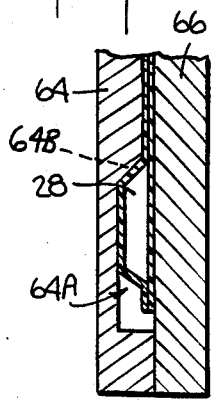
FIG. 9A is a sectional view showing a detail of the bursting station during the bursting operation.

Preferably, bursting plate 64 includes a recess 64A. This recess allows the fluid in rupturable bag 28 to fill the recess 64A, as shown in FIG. 9A, when bursting plate 64 moves toward plate 66. When recess 64A is sufficiently full, the side seams of bag 28 rupture. This allows the fluid in bag 28 to be directed in a controlled pattern, so that gas generation occurs as expected. For example, the inclined upper edge 64B of recess 64A allows the fluid in bag 28 to be directed upwards. Furthermore, recess 64A is also designed and placed in a location on plate 64 such that the fluid from bursting bag 28 does not blow out the side seals of pouch 12.

As shown more clearly in FIG. 2, bursting plate 64 to which cutting means 30 is attached, may include a hinged cover 72 to allow access to the cutting mechanism for maintenance. This cover is shown cut away in FIG. 1, and the hinge is shown at 74.

In order to prevent the pouch from immediately dropping from the bursting station after it has been separated from the continuous sheet of pouches, holding means, in the form of cylinders 76, are provided. The piston rods of these cylinders will normally extend into the area below bursting plate 64 to prevent the separated pouch from falling into the pouch deformation and insertion station 100 below before the preceding pouch has inserted into a container, each of which is indicated in the figures by reference numeral 80. The pouch deformation and insertion station is indicated in broken-away view in FIGS. 1 and 2 and is shown more clearly in side view in FIG. 3 as indicated generally by reference numeral 100.

Once the pouch 12 has been burst and separated from the following pouches in the continous sheet, the piston of cylinder 76 retracts to allow the cut-off pouch to fall into the opening 102 in the device 100. Movement of the pouch into the opening 102 can be facilitated by air pressure or vacuum.

With reference particularly to FIGS. 3, 8, 10, 11 and 12, device 100 includes a pair of parallel spaced side walls 110 and 112, side wall 112 being shown in cut away view to reveal the internal operation of device 100. Wall 110 may be formed integrally with plate 66 of the bursting station. Enclosing the space 102 between the parallel walls 110 and 112 are end walls 114 and 116, end wall 116 being adapted to receive a cylinder 118, which might be a pneumatically or hydraulically operated cylinder or some other activating means. The piston rod 119 of cylinder 118 is fastened to slidably movable compression block 120 which has a concave surface 122. Guide rails 124 having end stops 126 are securely fastened to compression block 120, as for example by being threaded into block 120 at 128. Rails 124 are slidably disposed in end block 116 and provide guiding support for compression block 120 when cylinder 118 is actuated. The movement of compression block 120 is limited by the end stops 126 when cylinder 118 forces block 120 in the direction of the arrow 130 in FIG. 11.

At one end of device 100, a vertically disposed bore or aperture 132 is formed by the concave surfaces formed by block 114 and movable block 120 once it has moved fully to the right, and curved surfaces 136 and 138 cut into walls 110 and 112 respectively. Into this bore, a piston 140 is slidably disposed. Piston 140 is connected to the piston rod 142 of an actuating cylinder 144.

Figure 10:
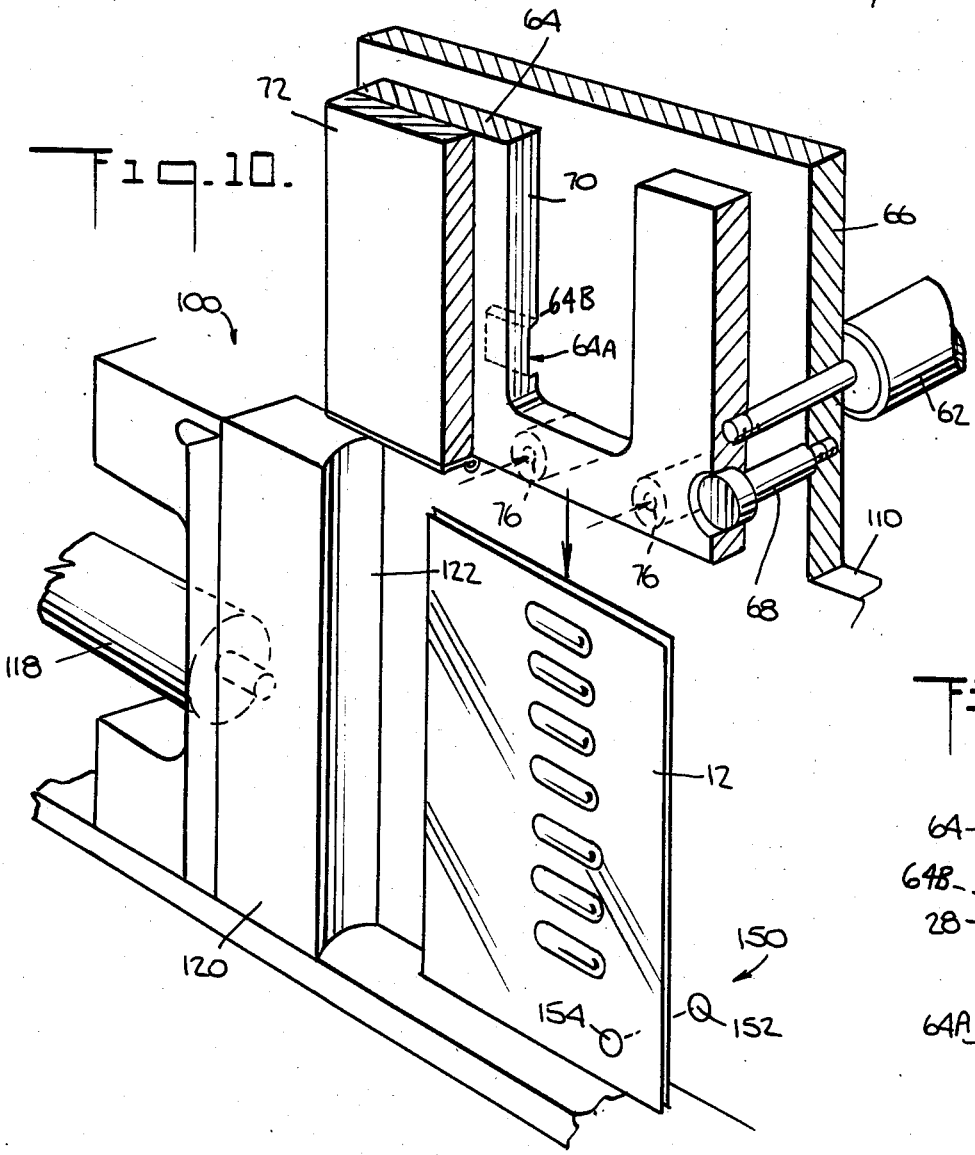
FIG. 10 is a sectional view showing the expandable pouch after bursting and just before deformation of the pouch into a collapsed state prior to insertion into a container.
Figures 11, 12, 13, 14:
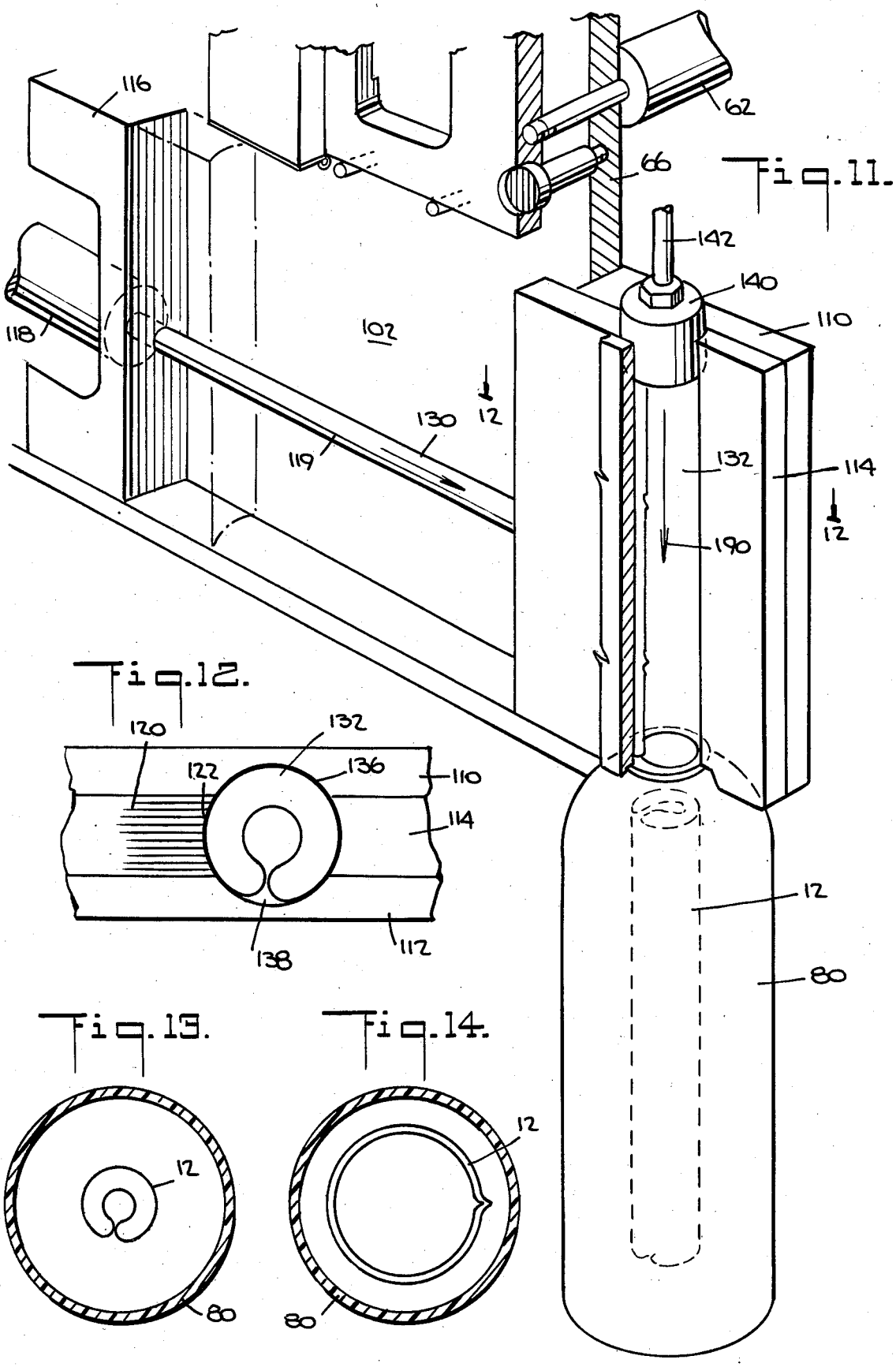
FIG. 11 shows the expandable pouch after deformation being inserted into a container.
FIG. 12 is a cross sectional top view of an expandable pouch in its collapsed state after deformation taken through lines 12—12 of FIG. 11.
FIG. 13 is a cross sectional top view showing the collapsed pouch after it has been inserted into container.
FIG. 14 is a top view showing the expandable pouch after it has expanded inside a container so as to pressurize the container.

The operation of device 100 may now be explained. Once a pouch 12 has been cut off from the continuous strip of pouches by the cutting means 30 and cylinders 76 have retracted, pouch 12 falls into the space 102 between side walls 110 and 112, as best shown in FIG. 10. Sensing means, generally shown at 150, such as a photocell 152 and lamp 154, may be provided to detect the pressure of the pouch 12 in the space 102. Cylinder 118 is actuated by control circuitry coupled to sensing means 150 and forces compression block 120 in the direction of arrow 130, as best shown in FIG. 11. The flexible pouch 12 is compressed to a collapsed, folded state in the cylinder bore 132 as shown, for example, in the cross sectional view of FIG. 12 taken through line 12—12 of FIG. 11. Preferably, device 100 causes a programmed compression of pouch 12 so that pouch 12 is folded in a set pattern before insertion into a container, for example, as shown in FIG. 12.

Once the compression block 120 has reached the limit of its travel, as determined by stops 126 (See FIG. 3), a limit switch 170, as best shown in FIG. 3, is actuated. The signal from limit switch 170 signals the control circuitry that block 120 has reached the end of its travel and that cylinder 144 may be energized to force the collapsed pouch 12 in bore 132 in the direction shown by the arrow 190 into a container 80 disposed directly below bore 132. The pouch 12 is shown in container 80 in cross sectional view in FIG. 13 just after insertion and in FIG. 14 after the chemical reaction within the pouch has generated sufficient propellant gas to expand the pouch, thus pressurizing the interior of container 80.

The conveyor means for conveying containers 80 into position below the cylinder bore 132 may now be described.

A first embodiment of the conveyor means is shown with reference to FIGS. 2, 3 and 4. As shown, the conveyor means includes a feed conveyor generally indicated at 200 and a takeaway conveyor generally indicated at 210. Each conveyor 200 and 210 may be of the continuous belt type, so that upper and lower portions of the belt for each conveyor are shown in the cross sectional view through the conveyor means in FIG. 2.

Containers 80 are conveyed to a point along feed conveyor 200 so that they are each, in turn, adjacent the cylinder bore 132 of pouch deformation and insertion device 100. An end stop bracket 221 may be used to prevent containers 80 from moving any further along the conveyor 200. Alternatively, if the conveyor serves several container stuffing apparatus, each substantially as herein described, end stop 220 may be replaced with a releasable lever mechanism indicated generally at 300 in FIG. 15 so that containers may be forwarded to successive container stuffing apparatus located at spaced intervals along the conveyor 200. Mechanism 300 will be described in greater detail later with reference to FIG. 15.

Once a container 80 has reached the end stop 221, a cylinder 212 which is secured to support plate 214 is actuated. A sensing means such as a switch 173 is used to determine that a container is in position. The piston rod 216 of cylinder 212 is secured to a movable plate 218.

Guide rails 220 are secured to support plate 214 and allow movable plate 218 is slidably move between end stop 222 secured to the guide rails 220 and support plate 214. Mounted to plate 218 is a pusher cam 224 which includes guide rails 226 along the surface which contacts containers 80. When a container reaches a position bearing against stop 221, cylinder 212 is actuated from its normal extended position to a retracted position, thus pushing container 80 from the feed conveyor onto the vertically movable table 230 disposed directly below cylinder bore 132. The containers 80 may be secured to the conveyor by cup retainers 232, which might be made of a ferromagnetic material so that they are slidably secured to the conveyors 200 and 210 by magnetic material 234 attached to the conveyors. At the same time that a container 80 is pushed onto the vertically movable table 230, the preceding container is pushed onto the take-away conveyor 210. Once the container has come to rest on the table 230, cylinder 236 is actuated, lifting table 230 via push rod 238 and universal joint spider 240. The container is raised so that the open top thereof is immediately beneath cylinder bore 132 in device 100. At this point cylinder 144 is actuated, ramming the compressed pouch 12 into the container 80. The cylinder 236 then retracts, allowing the table 230 to move away from device 100, with the top surface of table 230 again even with the top surface of conveyors 200 and 210. An unfilled container 80 from conveyor 200 is then pushed onto the table 230 by cam 224, forcing the just-filled container onto the take-away conveyor 210. The take-away conveyor removes the container 80 to further machinery or to a human operator where valve caps are fastened to the containers before propellant gas develops in the pouches in the containers. The fluid material to be dispensed from container 80 can be inserted therein either before or after the step of pouch insertion. Conveyor 200 and 210 may include various guard rails 250, 252, 254 and 256 to facilitate proper movement of containers 80 along the conveyors.

Figure 15:
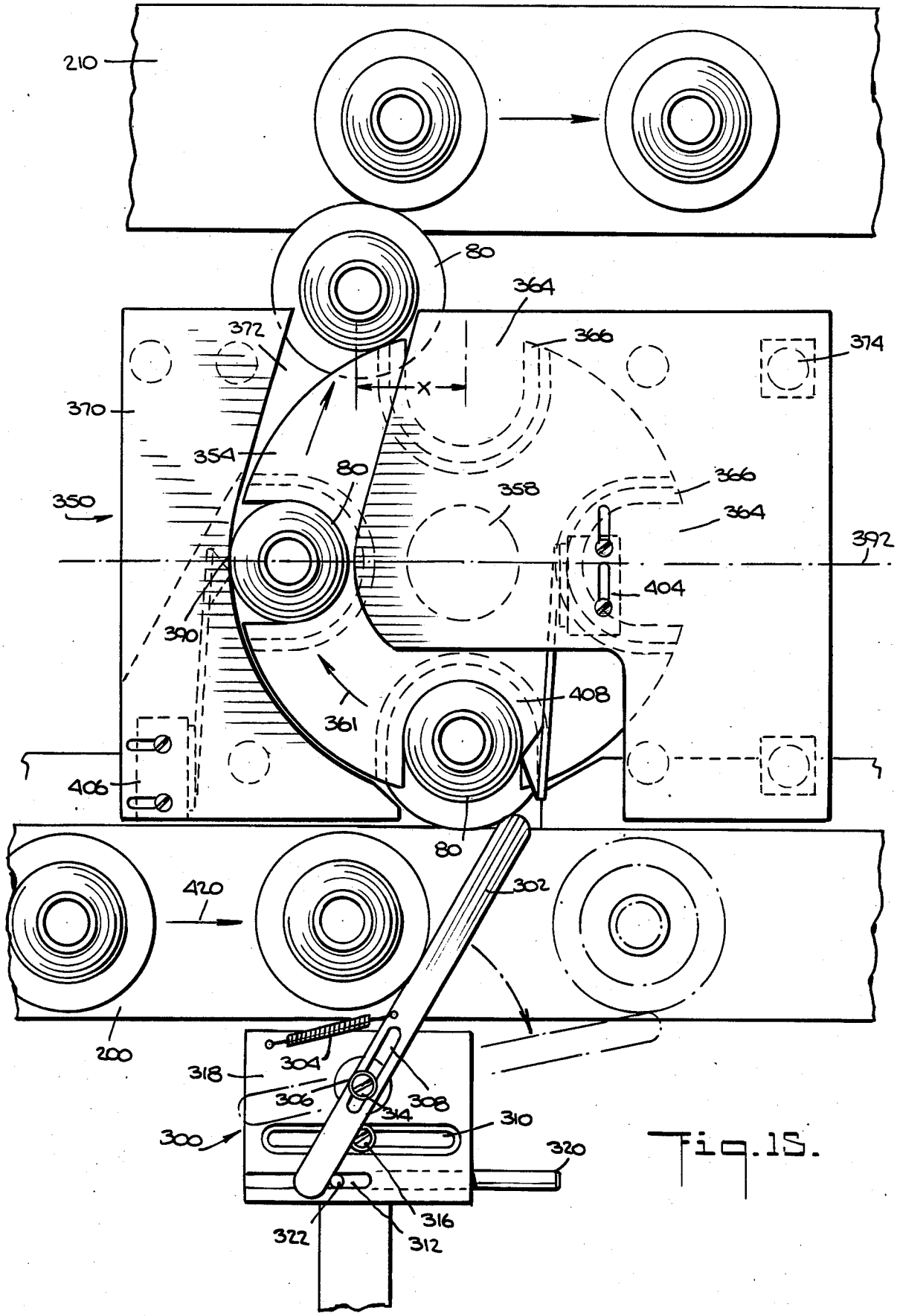
FIG. 15 is a top view of an alternative embodiment of the container conveyor system utilizing a turntable container positioning apparatus located below the pouch deformation and insertion station.
Figure 16:
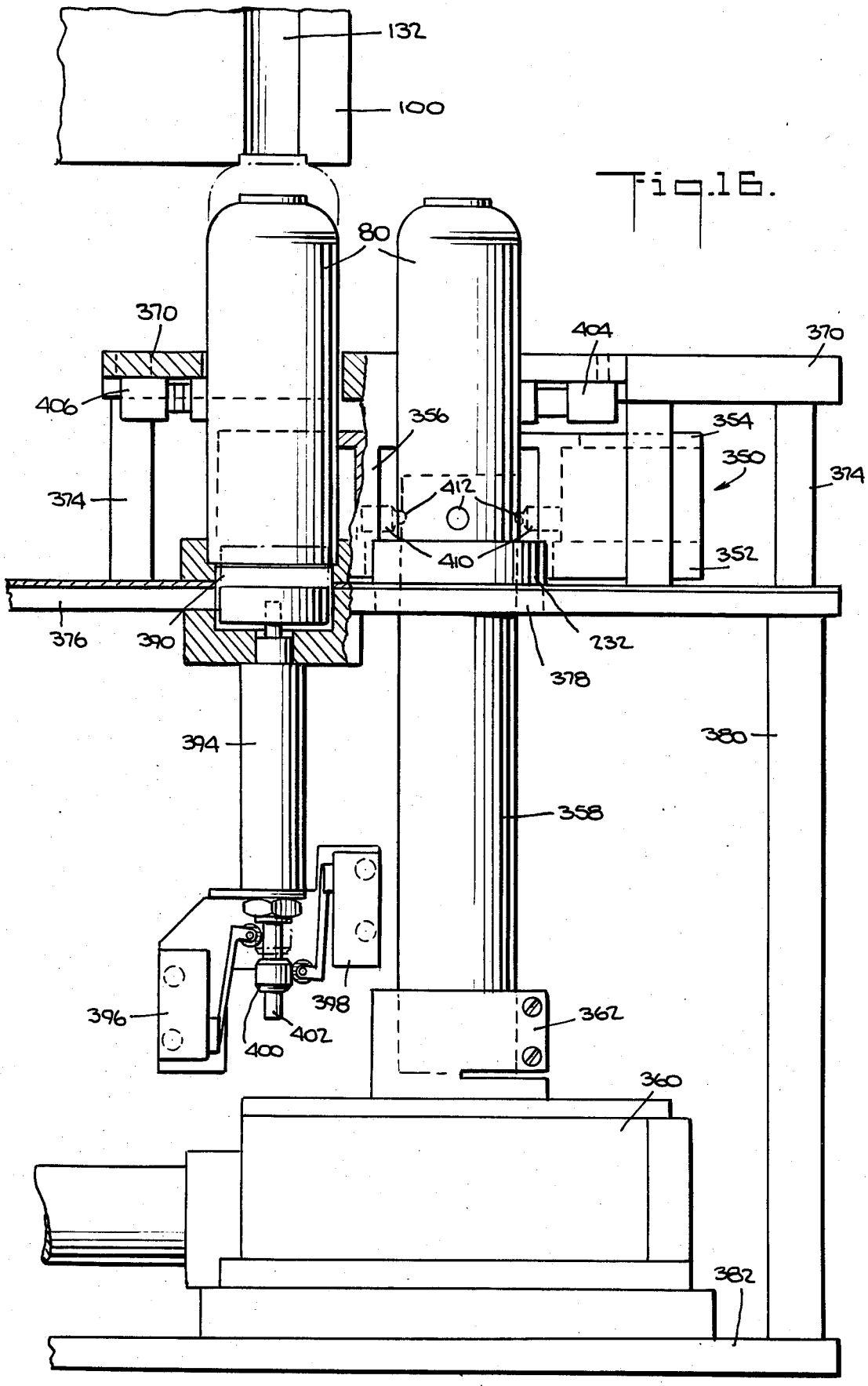
FIG. 16 is a side view of the turntable container positioning apparatus shown in FIG. 15.

An alternative embodiment of the conveyor and lifting table is shown in FIGS. 15 and 16. This embodiment includes feed conveyor 200 and take-away conveyor 210 substantially the same as described with regard to the first embodiment of the conveyor. Instead of using a pusher cam arrangement, this embodiment provides an indexing turntable, generally indicated at 350, including first and second indexed disk members 352 and 354 physically attached to each other by supports 356 or made integrally as a single unit. Turntable 350 is driven through a shaft 358 by an electric, pneumatic or hydraulic servo motor 360, for example. Shaft 358 may be secured to motor 360 via a clamp 362. Each disk member 352 and 354 of turntable 350 includes a plurality, in the illustrated embodiment, four, of indexing cuts 364 and 366 respectively. The indexing cut 364 in the upper disk 354 is narrower than the indexing cut 366 in the lower disk 352 because the upper disk only surrounds a container 80 while the lower disk surrounds the cup holder 232 into which the container is disposed.

A guide plate 370 having a curved channel 372 is disposed above the disk shaped members 352 and 354 and is supported by supports 374. A support platform 376 is disposed below the disk members 352 and 354 and includes bearings 378 for guiding the shaft 358. Support platform 376 is further supported by supports 380 to a base 382 to which motor 360 is mounted. A lifting table 390 is disposed below the turntable along the longitudinal center line 392 of the turntable 350 directly beneath the cylinder bore 132 of pouch deformation and insertion device 100. A cylinder 394 is used to raise and lower the table 390. Switches 396 and 398 operated by a cam 400 disposed on the cylinder rod 402 are used to sense the position of table 390. Switches 404 and 406 are mounted between disk member 354 and guide plate 370 and sense respectively the presence of a container in the entrance area 408 of the guide plate 370 and the presence of a container beneath the cylinder bore 132. Detents 410 which mate with corresponding recesses 412 in shaft 358 facilitate precise positioning of the turntable.

The operation of the turntable 350 may now be explained. Containers move in the direction of arrow 420 along the feed conveyor 200. Upon impacting lever 302 biased against the container by spring 304 and pivotably mounted at 306, and if no container is present in the entrance area 408, the container will be guided into area 408 by lever 302. If a container is present in area 408, the container will force the lever against the spring pressure to the position indicated by the phantom lines. The container will then travel along the conveyor 200 to the next turntable for pouch insertion. Slots 308, 310 and 312 are used to adjust lever arm 302 for proper operation. Slot 308 allows arm 302 to be moved so that it projects varying distances across the conveyor 200. A clamping screw 314 serves to lock the lever 302 in position. Similarly, screw 316 allows the support 318 to which lever 302 is attached to be moved laterally in the direction of slot 310. Arm 320 having depending abutment 322 may be locked in the slot 312 to adjust the angle of lever 302 with respect to the conveyor 200.

Once a container 80 is forced into entrance area 408 by lever 302, switch 404 is activated and a signal is generated which operates, after a small time delay, to drive turntable 350 via motor 360 an increment of 90° in the direction indicated by arrow 361. Once the container reaches the center line 392 of turntable 350, switch 406 is activated, causing motor 360 to be deenergized and stopping the turntable at this position. Detents 410 aid in precisely locating the turntable. At this point, cylinder 394 is actuated to raise table 390 and the container 80 disposed on it so that the opening in the container is immediately below the bore 132 in device 100. Switch 396 senses when the table has been raised into position and generates a signal to cause activation of device 100. After a preset time interval, when device 100 has completed its function, cylinder 394 is deactivated and the table 390 falls to its resting position, activating switch 398. Switch 398 generates a signal which allows turntable 350 to be driven by another increment of 90°. At the same time, of course, following containers 80 are being positioned on table 39 and are entering entrance area 408. When the container 80 reaches the exit area 372 of channel 354, it is forced outwardly by the movement of turntable 350. The center of exit area 372 is located a distance X ahead of the position at which the indexing cut in turntable 350 stops adjacent take-away conveyor 210. Once the container 80 reaches the conveyor 210, it is carried away for further processing. Guide rails 256 and 254 as shown in FIG. 4 may likewise be used in this embodiment to properly guide the container.

Figure 17:
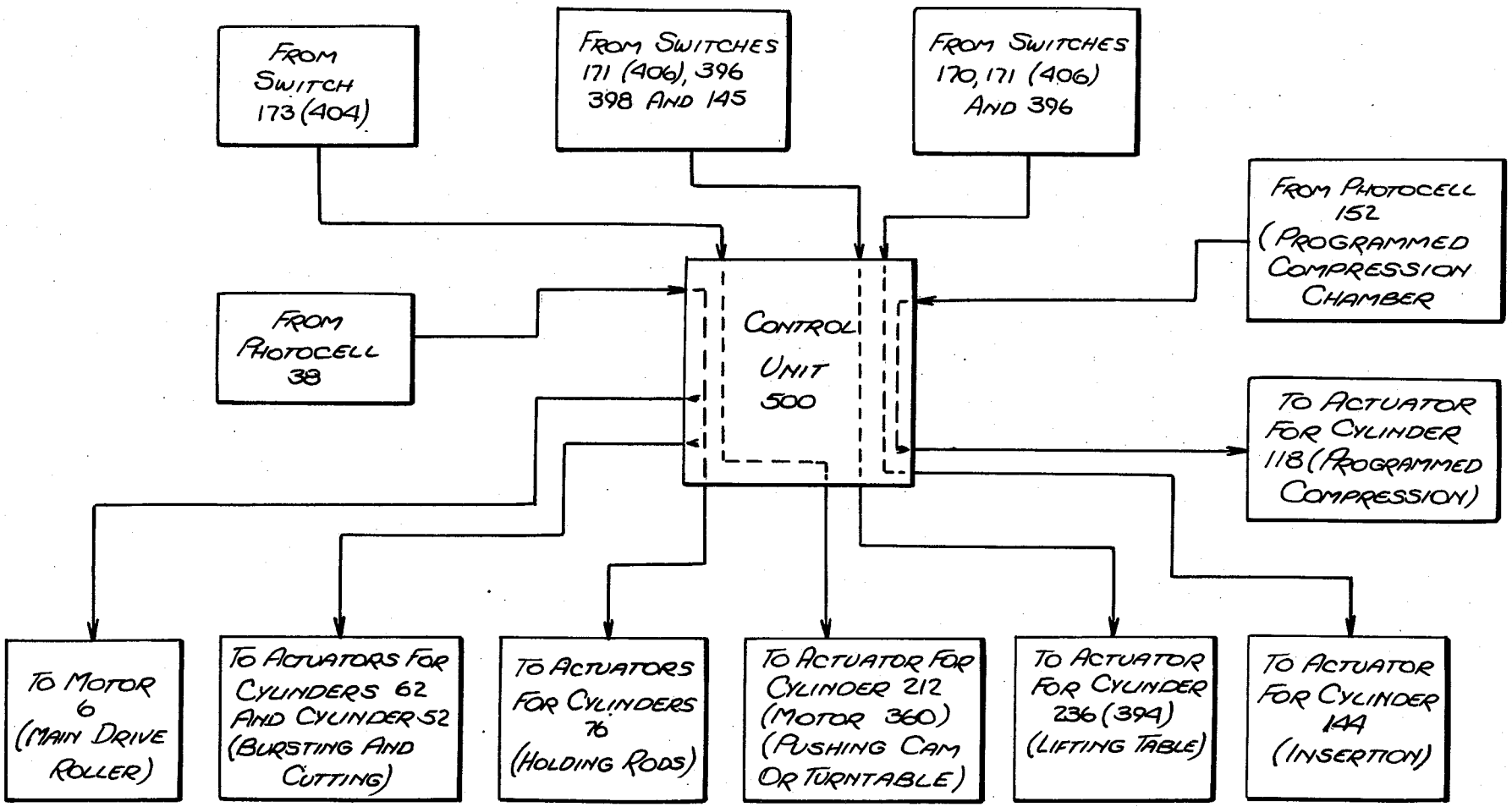
FIG. 17 is a block diagram of one embodiment of the control circuitry used to control the apparatus of the present invention.

FIG. 17 is a block diagram of one embodiment of the control circuitry for one embodiment of the apparatus, showing the control unit 500 and the various sensor inputs and outputs coupled to the various actuators. Control unit 500 may be a hardwired logic circuit or may be implemented by a small computer or microprocessor. Although some of the sensor inputs to the control unit 500 have already been described, the operation of the control circuitry will now be discussed in greater detail.

As discussed previously, an output signal from photocell 38 (FIG. 3) indicates that a pouch 12 is in position between the bursting plates 64 and 66. The control unit 500 accordingly stops motor 6 momentarily and commands the cylinders 62 to retract, thereby bursting bag 28. The cutting means cylinder 52 is thereafter activated a short delay time later to move the cutting blade 42 across the continuous sheet to separate a pouch from the sheet, thereby separating the pouch between bursting plates 64 and 66 from the continuous sheet. Once the cutting and bursting operation is complete, cylinders 76 are retracted, allowing the separated pouch to fall into the receiving chamber 102 of device 100. Photocell 152 (FIG. 10) senses when this has occurred and the control unit issues a signal causing cylinder 118 to extend, collapsing the pouch into an elongate shape.

Cylinder 144 must now be actuated. Prior to actuation, several conditions must exist, as determined by the various sensors and switches of the apparatus. In FIG. 17, reference numerals in parenthesis indicate that the particular components are found in the alternate embodiment of the conveyor system using the turntable of FIGS. 15 and 16. Firstly, the apparatus must sense whether a container is present on the conveyor 200 ready to be moved onto the lifting table. This is sensed by switch 173 (FIG. 4) or 404 (FIG. 15), which causes the control unit to issue a signal energizing cylinder 212 (FIG. 2) or motor 360 (FIG. 16) so as to place a container in position for pouch insertion. Switch 171 (FIG. 4) or switch 406 (FIG. 15) sense when a container is present below the cylindrical aperture 132. Once such a container is present, the control unit determines, from the position of switches 396 and 398, that the lifting table is in its rest position. Switches 396 and 398 are employed in the embodiment of the apparatus shown in FIGS. 1, 2 and 3 as well as in the alternate embodiment shown in FIG. 15. The lifting table cylinder 236 or 394 then extends to raise the table, actuating switch 396. Once switch 396 has been actuated, cylinder 144 may be actuated to insert the compressed pouch into the container. Switch 145 (FIG. 3) senses that the cylinder has extended its full length and thus that the pouch has been inserted into the container. A short time later, the control unit issues a signal allowing the table and cylinder 144 to retract, allowing cylinder 212 or turntable motor 360 to be activated, thus moving the stuffed container away and the next container into position, whereby the process repeats itself.

Figure 18:
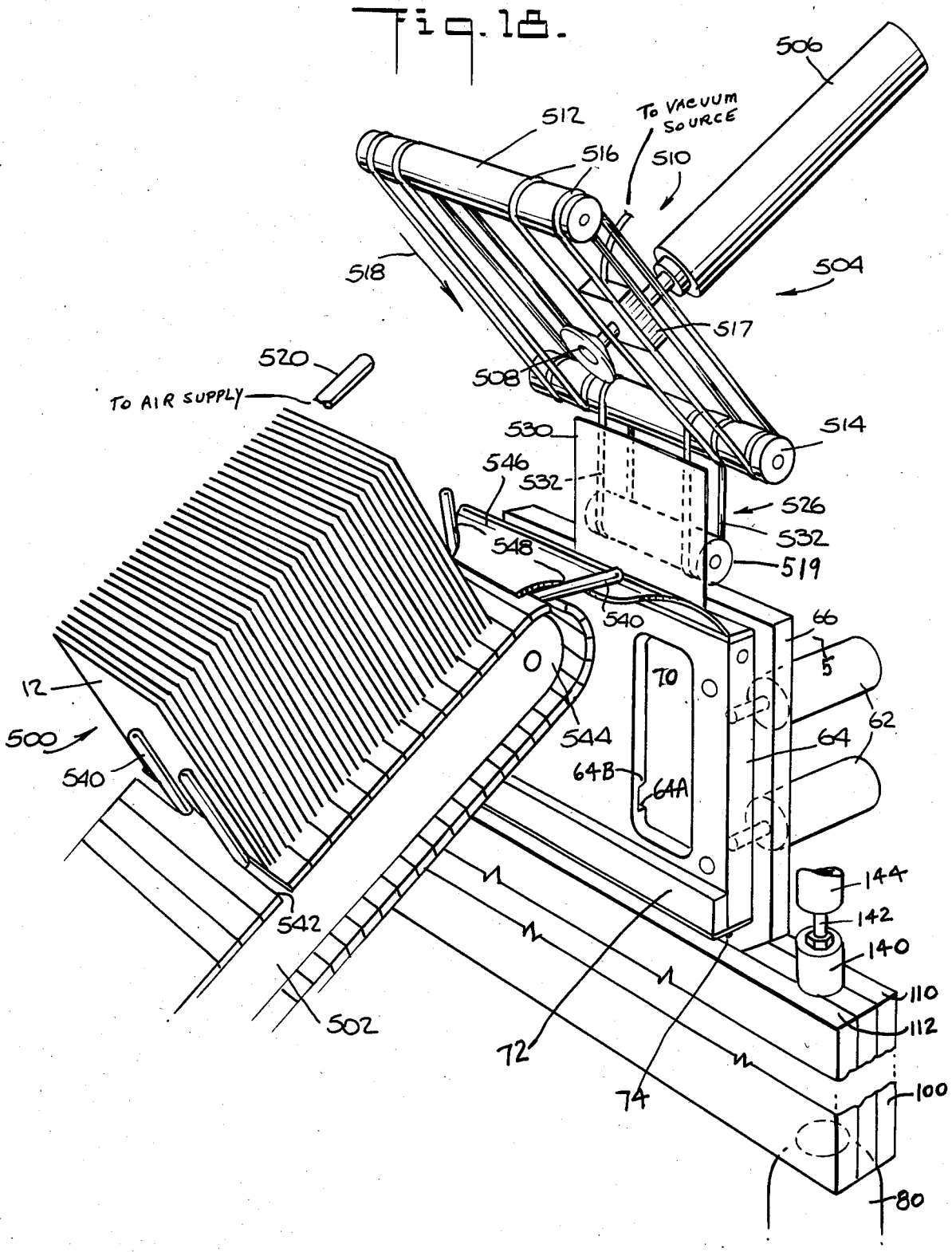
FIG. 18 is a perspective view of an alternate embodiment of the invention illustrating an alternative apparatus for feeding expandable pouches to the bursting station and wherein the pouches are not packaged in a continuous sheet.

FIG. 18 illustrates an alternative embodiment of the apparatus for feeding pouches to the bursting plates 64 and 66. In this embodiment, pouches 12 are individually stacked in a preselected position, for example, longitudinally along a conveyor 502, as shown at 500 in FIG. 18, as opposed to being packaged in a continuous sheet as shown in FIG. 1. Pouches 12 are stacked on an indexing conveyor 502 and fed to a pickup and place mechanism 504 includes an actuating cylinder 506. At the end of the cylinder rod of cylinder 506, a grasping device, such as a suction cup 508, which may be coupled to a source of vacuum via manifold 517, is disposed. Manifold 517 is mounted on the cylinder rod of cylinder 506 and has an inlet connected to a source of vacuum. An outlet of the manifold is connected to the suction cup 508, preferably via a longitudinal aperture in the cylinder rod. Alternatively, more than one suction cup could be used for grasping pouch 12. Grasping device 508 picks up a pouch 12 from stack 500 and places it against endless belt assembly 510 including pulleys 512 and 514 and belts 516. Belts 516 move as indicated by arrows 518 due to the rotation of pulleys 512 and 514. In order to hold pouch 12 against belts 516 once the source of vacuum is removed, an air blast jet 520 coupled to a source of air pressure is utilized. Alternatively, vacuum openings disposed adjacent belts 516 could be used to keep pouch 12 in contact with belts 516.

Belt assembly 510 preferably is disposed at the same angle as pouches 12 on conveyor 502. Conveyor 502 preferably is disposed at an angle to the horizontal, for space saving and stacking considerations, such as at an angle of 60° from the horizontal.

Under the influence of the air blast, belts 516 guide pouch 12 to second endless belt assembly 526. A guide plate 530 is disposed in front of belt assembly 526, assuring that the pouches are delivered into the opening between bursting plates 64 and 66. Belts 532 of belt assembly 526 preferably are disposed in the same plane as bursting plates 64 and 66 and are moved by rotating pulleys 514 and 519.

Conveyor 502 preferably includes a series of cleats 540. Pouches 12 are preferably organized on conveyor 502 in groups of, for example, 100 pouches minimum. Spaced cleats 540 of conveyor 502 extend through apertures 542 in the conveyor belt. These cleats serve to organize pouches 12 in groups, as discussed. In order to form cleats 540 out of the path of burster plate 64, which they might contact as they move around end 544 of conveyor 502, a guide plate 546 is provided which forces spring loaded cleats 540 at an acute angle to the top plane of conveyor 502 so that they clear burster plate 64. Plate 546 includes cam surfaces 548 disposed thereon for accomplishing this function.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. Apparatus for inserting flexible sheet products into containers, each of said products comprising an expandable pouch for pressurizing a container, said pouch including burstable means for generating pressurizing gas within said pouch, said apparatus comprising:

first plate means disposed at a first location;

second plate means disposed at the first location extending parallel to and adjacent said first plate means and spaced apart therefrom, said sheet products being received between said first and second plate means;

actuating means for relatively moving said first and second plate means toward each other so as successively to compress said flexible sheet products to burst said burstable means;

means for deforming said sheet products into an elongate shape, said deforming means being disposed at a second location spaced away from said first location whereby said compressed sheet products must move from said first location to and second location to be deformed; and means for successively inserting said deformed sheet products into the containers.

2. Apparatus as recited in claim 1, wherein said means for deforming said sheet products into an elongate shape prior to insertion into said container comprises:

means having an internal chamber having generally flat sides and first and second edges for receiving said flexible sheet products; and pusher means mounted in said chamber extending along said first edge thereof and movable laterally toward and away from the second chamber edge, for deforming said flexible sheet product in said chamber into an elongate folded sheet product extending along said second chamber edge;

and wherein said means for inserting comprises:

ejector means movable in said chamber along said second edge for endwise ejection of said folded sheet product into a container.

3. Apparatus as recited in claim 1 wherein said sheet products are packaged in a continuous sheet of said products, and further comprising:

means for receiving said continuous sheet of said sheet products prior to bursting including main roller means having a friction surface along the circumference of said main roller means for engaging said flexible sheet products and idler roller means biased against said main roller means, said flexible sheet products guided between said main roller means and said idler roller means; and cutting means disposed adjacent one of said plate means for successively separating each of said sheet products from said continuous sheet after said first and second plate means burst said burstable means.

4. Apparatus as recited in claim 3 wherein said cutting means comprises:

horizontally extending guide means disposed on one of said plate means;

a cutting knife slidably disposed on said guide means;

said actuating means further moving said cutting knife into engagement with said flexible sheet product; and means for moving said cutting knife from a first position to a second position along said guide means so as to separate said sheet product from said continuous sheet.

5. Apparatus as recited in claim 4 wherein said actuating means for relatively moving said first and second plate means and for moving said cutting knife into engagement with said sheet product comprises cylinder means and said means for moving said cutting knife along said guide means comprises cylinder means.

6. Apparatus as recited in claim 4, further comprising means for sensing when each sheet product is to be separated from said continuous sheet and for activating said cutting means.

7. Apparatus as recited in claim 6 wherein said guide means is connected to one of said plate means whereby when said first and second plate means relatively move toward each other, said cutting means is activated to separate said flexible sheet product from said continuous sheet.

8. Apparatus as recited in claim 1, further comprising conveyor means for conveying said containers for receiving said separated sheet products to a position below said inserting means.

9. Apparatus as recited in claim 1, further comprising means for directing fluid contained within said burstable means in a predetermined direction in said pouch when said burstable means is ruptured by said first and second plate means.

10. Apparatus as recited in claim 1 wherein one of said first and second plate means includes recess means disposed in alignment with part of said burstable means of said pouch on an inner surface of one of said first and second plate means, said recess means being arranged so that fluid contained within said burstable means is forced into said recess means when said first and second plate means relatively move toward each other, the fluid in said burstable means thereby being directed in a predetermined direction in said pouch.

11. Apparatus as recited in claim 10 wherein said recess means has an edge having an inclined surface for directing fluid contained within said burstable means in a direction determined by said surface.

12. Apparatus as recited in claim 1, further comprising:

transporting means for transporting individual ones of said flexible sheet products to said first and second plate means and for inserting said flexible sheet products between said first and second plate means, said flexible sheet products arranged on said transporting means in adjacent side by side relation.

13. Apparatus as recited in claim 12 wherein said transporting and inserting means comprising:

first conveyor means for conveying said flexible sheet products to a first position;

means for engaging said sheet products at said first position; and second conveyor means for conveying said sheet products from said first position to a second position between said first and second plate means.

14. Apparatus as recited in claim 13 wherein said engaging means comprises suction means for retrieving said sheet products from said first conveyor means and for moving said sheet products into contact with said second conveyor means and wherein said second conveyor means comprises endless belt means.

15. Apparatus as recited in claim 14, further comprising means for directing a blast of air against said endless belt means to keep said sheet product in contact with said endless belt means.

16. Apparatus as recited in claim 15, further comprising guide means disposed in front of at least part of said endless belt means for guiding said sheet product between said guide means and said endless belt means to a position between said first and second plate means.

17. Apparatus for inserting flexible sheet products into containers, each of said products comprising an expandable pouch for pressurizing a container, said pouch including burstable means for generating pressurizing gas within said pouch, said apparatus comprising:

means for compressing said sheet products so as to rupture said burstable means comprising first plate means, second plate means extending parallel to and adjacent said first plate means and spaced apart therefrom, said sheet products being received between said first and second plate means, and actuating means for relatively moving said first and second plate means toward each other so as successively to compress said flexible sheet products to burst said burstable means, said pouch including an area which is not to be compressed and one of said first and second plate means including an aperture disposed so that when said pouch is received between said first and second plate means, said area which is not to be compressed is located in alignment with said aperture, thereby preventing compression of said area when said first and second plate means relatively move toward each other;

means for deforming said sheet products into an elongate shape;

means for successively inserting said elongate sheet products into the containers; and conveyor means for conveying said containers for receiving said sheet products to a position below said inserting means.

18. Apparatus as recited in claim 17 wherein one of said first and second plate means further includes recess means disposed in alignment with part of said burstable means of said pouch on an inner surface of one of said first and second plate means, said recess means being arranged so that fluid contained within said burstable means is forced into said recess means when said first and second plate means relatively move toward each other, the fluid in said burstable means thereby being directed in a predetermined direction in said pouch.

19. Apparatus as recited in claim 17, further comprising holding means for holding said flexible sheet product between said first and second plate means.

20. Apparatus as recited in claim 19, wherein said holding means comprise rod means extending into said space between said first and second plate means near the bottom edges of said first and second plate means, said rod means retracting so as to allow said sheet product to be received by said means for deforming said sheet product.

21. Apparatus as recited in claim 17 wherein said actuating means comprises cylinder means.

22. Apparatus as recited in claim 17, further comprising:

transporting means for transporting individual ones of said flexible sheet products to said first and second plate means and for inserting said flexible sheet products between said first and second plate means, said flexible sheet products arranged on said transporting means in adjacent side by side relation.

23. Apparatus as recited in claim 22 wherein said transporting and inserting means comprises:

first conveyor means for conveying said flexible sheet products to a first position;

means for engaging said sheet products at said first position; and second conveyor means for conveying said sheet products from said first position to a second position between said first and second plate means.

24. Apparatus as recited in claim 23 wherein said engaging means comprises suction means for retrieving said sheet products from said first conveyor means and for moving said sheet products into contact with said second conveyor means and wherein said second conveyor means comprises endless belt means.

25. Apparatus as recited in claim 24, further comprising means for directing a blast of air against said endless belt means to keep said sheet product in contact with said endless belt means.

26. Apparatus as recited in claim 25, further comprising guide means disposed in front of at least part of said endless belt means for guiding said sheet product between said guide means and said endless belt means to a position between said first and second plate means.

27. Apparatus as recited in claim 17 wherein siad sheet products are packaged in a continuous sheet of said products, and further comprising cutting means coupled to said compressing means for successively separating said sheet products from said continuous sheet subsequent to rupture of said burstable means.

28. Apparatus for separating flexible sheet products from a continous sheet of said products and for inserting the separated products into containers, each of said products comprising an expandable pouch for pressurizing a container, said pouch including burstable means for generating pressurizing gas within said pouch, said apparatus comprising:

means for bursting said burstable means of said flexible sheet product comprising first plate means, second plate means extending parallel to and adjacent said first plate means and spaced apart therefrom, said sheet products being received between said first and second plate means and actuating means for relatively moving said first and second plate means toward each other so as successively to compress said flexible sheet products to burst said burstable means;

means for successively separating said flexible sheet products from said continuous sheet comprising guide means connected to one of said first and second plate means, cutting means slidably disposed on said guide means and platen means spaced apart from said cutting means, said actuating means moving said cutting means toward said platen means so as to cut a sheet product from said continuous sheet disposed between said cutting means and said platen means when said first and second plate means move toward each other;

means for deforming said separated sheet products into an elongate shape;

means for successively inserting said elongate sheet products into containers; and conveyor means for conveying said containers for receiving said separated sheet products to a position below said inserting means.

29. Apparatus as recited in claim 28 wherein said guide means comprises horizontally extending rail means, said separating means further comprising means for moving said cutting means from a first position to a second position along said rail means so as to separate said sheet product form said continuous sheet.

30. Apparatus as recited in claim 28 wherein said conveyor means further comprises means for removing each container from a position below said inserting means after said sheet product has been inserted into said container.

31. Apparatus as recited in claim 30 wherein said conveyor means comprises:

first means for moving a plurality of containers successively to a position adjacent said inserting means;

second means for successively moving each container away from said first means and to a position below said inserting means and for moving each container once a flexible sheet product has been inserted therein away from said inserting means; and third means for successively receiving each container from said second means once a flexible sheet product has been inserted therein.

32. Apparatus as recited in claim 38 wherein said conveyor means comprises:

first means for moving a plurality of containers successively to a position adjacent said inserting means;

turntable means disposed below said inserting means;

means for directing each of said containers from said first means onto said turntable means;

means for guiding each of said containers on said turntable means to a position below said inserting means and subsequently away from said inserting means; and second means for moving each of said containers away from said turntable means;

said turntable means receiving each of said containers and moving each of said containers successively to a position below said inserting means so that said flexible sheet products may be inserted into said containers.

33. Apparatus as recited in claim 28, wherein said inserting means includes a vertically disposed cylindrical aperture from which said compressed sheet product is ejected, and further comprising lifting table means disposed below said aperture for raising said container into which a flexible sheet product is to be inserted so that said container is disposed immediately below said aperture.

34. Apparatus for inserting flexible sheet products into containers, each of said products comprising an expandable pouch for pressurizing a container, said pouch including burstable means for generating pressurizing gas within said pouch, said apparatus comprising:

means for bursting said burstable means of said flexible sheet product comprising first plate means, second plate means extending parallel to and adjacent said first plate means and spaced apart therefrom, said sheet product being received between said first and second plate means, and actuating mean for relatively moving said first and second plate means substantially completely toward each other except for a thickness of said flexible sheet product received between the plate means so as successively to compress said flexible sheet products to burst said burstable means;

means for deforming said sheet products into an elongate shape including means having an internal chamber having generally flat sides and first and second edges for receiving said flexible sheet products and pusher means mounted in said chamber extending along said first edge thereof and movable laterally toward and away from the second chamber edge, for deforming said flexible sheet product in said chamber into an elongate folded sheet product extending along said second chamber edge;

means for successively inserting said folded sheet products into the containers including ejector means movable in said chamber along said second edge for endwise ejection of said folded sheet products into the containers; and conveyor means for conveying said containers for receiving said sheet products to a position below said inserting means.

35. Apparatus as recited in claim 34 wherein said conveyor means further comprises means for removing each container from a position below said inserting means after said sheet product has been inserted into said container, said conveyor means comprising:

first means for moving a plurality of containers successively to a position adjacent said inserting means;

second means for successively pushing each container away from said first means and to a position below said ejector means and for pushing each container once a flexible sheet product has been inserted therein away from said inserting means; and third means for successively receiving each container from said second means once a flexible sheet product has been inserted therein.

36. Apparatus as recited in claim 35, further comprising lifting table means disposed below said ejector means for raising said container into which a flexible sheet product is to be inserted so that said container is disposed immediately below said ejector means.

37. Apparatus as recited in claim 36, further comprising cylinder means for raising said table means.

38. Apparatus as recited in claim 35, wherein said second means comprises pusher cam means for engaging a container, guide means on which said pusher cam means is slidably disposed and cylinder means for moving said pusher cam means.

39. Apparatus as recited in claim 34, further comprising:

transporting means for transporting individual ones of said flexible sheet products to said first and second plate means and for inserting said flexible sheet products between said first and second plate means, said flexible sheet products arranged on said transporting means in adjacent side by side relation.

40. Apparatus as recited in claim 39 wherein said transporting and inserting means comprises:

first conveyor means for conveying said flexible sheet products to a first position;

means for engaging said sheet products at said first position; and second conveyor means for conveying said sheet products from said first position to a second position between said first and second plate means.

41. Apparatus as recited in claim 40 wherein said engaging means comprises suction means for retrieving said sheet products from said first conveyor means and for moving said sheet products into contact with said second conveyor means and wherein said second conveyor means comprises endless belt means.

42. Apparatus as recited in claim 41, further comprising means for directing a blast of air against said endless belt means to keep said sheet product in contact with said endless belt means.

43. Apparatus as recited in claim 42, further comprising guide means disposed in front of at least part of said endless belt means for guiding said sheet product between said guide means and said endless belt means to a position between said first and second plate means.

44. Apparatus as recited in claim 34 wherein said conveyor means further comprises means for removing each container from a position below said inserting means after said sheet product has been inserted into said container, said conveyor means comprising:

first means for moving a plurality of containers successively to a position adjacent said inserting means;

turntable means disposed below said inserting means;

means for directing each of said containers from said first means onto said turntable means;

means for guiding each of said containers on said turntable means to a position below said inserting means and subsequently away from said inserting means; and second means for moving each of said containers away from said turntable means;

said turntable means receiving each of said containers and moving each of said containers successively to a position below said inserting means so that said flexible sheet products may be inserted into said containers.

45. Apparatus as recited in claim 34 wherein said flexible sheet products are packaged in a continuous sheet of said products and further comprising means for successively separating said flexible sheet products from said continuous sheet comprising guide means connected to one of said first and second plate means, cutting means slidably disposed on said guide means, platen means spaced apart from cutting means, said actuating means moving said cutting means toward said platen means so as to cut a sheet product from said continuous sheet disposed between said cutting means and platen means when said first and second plate means relatively move toward each other.

46. Apparatus as recited in claim 34, further comprising means for directing fluid contained within said burstable means in a predetermined direction in said pouch when said burstable means is ruptured by said first and second plate means.

47. Apparatus as recited in claim 46 wherein said means for directing fluid comprises recess means disposed on an inside surface of one of said first and second plate means in alignment with at least part of said burstable means of said pouch.

48. In an apparatus including means for inserting flexible sheet products into containers, conveyor means comprising:

first linear conveyor means for moving a plurality of containers successively to a position adjacent said inserting means;

turntable means disposed below said inserting means;

means for directing each of said containers in a direction substantially perpendicular to the longitudinal direction of said first means from said first means onto said turntable means;

second means for moving each of said containers away from said turntable means;

means for guiding each of said containers on said turntable means to a position below said inserting means and subsequently away from said inserting means, said guiding means comprising plate means disposed above said turntable means, said plate means having a channel separating said plate means into two sections, said channel having an entrance area for receiving each of said containers and an exit area for forcing each of said containers onto said second means, said channel extending along a part of the periphery of said turntable means continuously from said entrance area to said exit area;

said turntable means receiving each of said containers and moving each of said containers successively to a position below said inserting means so that said flexible sheet products may be inserted into said containers.

49. Conveyor means as recited in claim 48, wherein said turntable means comprises a turntable having a plurality of slots for receiving said containers evenly distributed adjacent the circumference of the turntable and said guiding means has a generally curved shape, corresponding, at least in part, to the periphery of said turntable means.

50. Conveyor means as recited in claim 49 wherein said apparatus further includes means for deforming said sheet products into an elongate shape prior to insertion into a container and said inserting means comprising ejector means disposed in a cylindrical aperture for ramming said elongate sheet product into said container, said conveyor means further comprising lifting means disposed below said cylindrical aperture whereby when said container is moved into a position below said cylindrical aperture, said lifting means is actuated to raise said container into a position immediately below said cylindrical aperture to receive said elongate sheet product.

51. Conveyor means as recited in claim 50, further comprising detent means for locking said turntable means into fixed position so that a container on said turntable into which an elongate sheet product is to be inserted is disposed in substantial alignment with said cylindrical aperture.

52. Conveyor means as recited in claim 50, further comprising first sensing means for determining when a container has moved into said entrance area of said channel and means responsive to said first sensing means for energizing said turntable means.

53. Conveyor means as recited in claim 52, further comprising second sensing means for determining when said container into which an elongate sheet product is to be inserted is below said cylindrical aperture and means responsive to said second sensing means for stopping said turntable means.

54. Conveyor means as recited in claim 53, further comprising means responsive to said second sensing means for energizing said lifting means.

55. Conveyor means as recited in claim 53, further comprising means for sensing the relative position of said lifting means.

56. Conveyor means as recited in claim 48, wherein said directing means comprises:

lever means pivotably mounted adjacent said first means and extending across said first means; and spring means biasing said lever means against stop means;

whereby said containers on said first means are guided onto said turntable means by said lever means, said lever means being forced away from said first means when said turntable means cannot accept a container so that a container not accepted by said turntable means continues past said lever means on said first means.

57. A method for separating flexible sheet products from a continuous sheet of said products and for inserting the separated products into containers, each of said products comprising an expandable pouch for pressurizing a container, said pouch including burstable means for generating pressurizing gas within said pouch, said burstable means contained within an area of said sheet product, said method comprising the steps of:

compressing said sheet product by receiving said sheet product between plate means and relatively moving said plate means toward each other to burst said burstable means;

separating said sheet product from the continuous sheet by cutting said continuous sheet in a direction transverse to the longitudinal direction of said continuous sheet between each said flexible sheet product, said step of cutting being initiated substantially simultaneously with said step of comprising;

deforming said separated sheet product into an elongate shape;

conveying a container to a position whereby said container is ready to receive said separated sheet product; and inserting said deformed separated sheet product into said container.

58. The method recited in claim 57, further comprising the step of holding said separated flexible sheet product prior to deforming said flexible sheet product into an elongate shape.

59. The method recited in claim 57, further comprising the step of removing said container after said sheet product has been inserted into the container.

60. The method recited in claim 59 wherein:

said step of conveying comprises:

moving a plurality of containers successively to a first position adjacent a second position where each container will receive said sheet product; and moving each container from said first position to said second position where the sheet product is inserted in said container; and said step of removing comprises:

moving said container from said second position to a third position once said flexible sheet product has been inserted therein.

61. The method recited in claim 60, further comprising the step of raising said container in said second position prior to insertion of said sheet product into said container.

62. The method recited in claim 57 wherein said step of cutting comprises the step of moving a cutting blade toward the continuous sheet of said products simultaneously with said step of compressing and thereafter moving the cutting blade from a first position to a second position across said continuous sheet to separate a sheet product therefrom.

63. A method for inserting flexible sheet products into containers, each of said products comprising an expandable pouch for pressurizing a container, said pouch including burstable means for generating pressurizing gas within said pouch, said burstable means contained within an area of said sheet product and having first and second surfaces adapted to contact each other upon bursting and a fluid contained therebetween, said method comprising the steps of:

receiving successive individual ones of said flexible sheet products;

compressing said sheet product at a first location so that substantially the entire surfaces of said burstable means contact each other thereby bursting said burstable means;

transferring said compressed sheet product to a second location spaced away from said first location;

deforming said sheet product into an elongate shape at said second location;

conveying a container to a position whereby said container is ready to receive said sheet product; and inserting said elongate sheet product into said container.

64. The method recited in claim 63, further comprising the step of holding said flexible sheet product prior to deforming said flexible sheet product into an elongate shape.

65. The method recited in claim 63, further comprising the step of removing said container after said sheet product has been inserted into the container.

66. The method recited in claim 65 wherein:

said step of conveying comprises:

moving a plurality of containers successively to a first position adjacent a second position where each container will receive said sheet product; and moving each container from said first position to said second position where the sheet product is inserted in said container; and said step of removing comprises:

moving said container from said second position to a third position once said flexible sheet product has been inserted therein.

67. The method recited in claim 66, further comprising the step of raising said container in said second position prior to insertion of said sheet product into said container.

68. The method recited in claim 63 wherein said step of compressing comprises receiving said sheet product between two plate means and relatively moving said plate means toward each other to burst the burstable means of said sheet product.

69. The method recited in claim 68 wherein said step of compressing comprises the step of forcing fluid contained within said burstable means into a small recess in one of said plate means to burst said burstable means so as to direct the fluid in a predetermined direction.

70. The method recited in claim 63 wherein said step of compressing comprises the step of forcing fluid contained within said burstable means into a small section of said area to burst said burstable means so as to direct the fluid in a predetermined direction.

71. Apparatus for inserting flexible sheet products into containers, each of said products comprising an expandable pouch for pressurizing a container, said pouch including burstable means for generating pressurizing gas within said pouch, said apparatus comprising:

means for compressing said sheet products so as to rupture said burstable means disposed at a first location;

means for deforming said sheet products into an elongate shape disposed at a second location spaced apart from said first location whereby said compressed sheet products must move from said first location to said second location to be deformed;

means for successively inserting said elongate sheet products into the container; and conveyor means for conveying said containers for receiving said sheet products to a position below said inserting means.

* * * * *

UNITED STATES PATENT AND TRADEMARK OFFICE

CERTIFICATE OF CORRECTION

PATENT NO. : 4,696,145

DATED : September 29, 1987

INVENTOR(S) : RICHARD SCHMIDT, et al

It is certified that error appears in the above-identified patent and that said Letters Patent is hereby corrected as shown below:

Column 2, line 42, after "timed" insert --release--.
Column 5, line 11, after "into" insert --a--.
Column 7, line 30, after "has" insert --been--.
Column 12, line 65, change "and" to --said--.
Column 14, line 26, change "comprising" to --comprises--.
Column 16, line 63, change "38" to --30--.
Column 17, line 34, change "mean" to --means--.
Column 19, line 18, after "and", first occurrence, insert --said--.
Column 20, line 66, change "comprising" to --compressing--.

Signed and Sealed this

Tenth Day of May, 1988

*Attest:*

*Attesting Officer*

DONALD J. QUIGG

*Commissioner of Patents and Trademarks*